US005882585A

United States Patent [19]

Wegner et al.

[11] Patent Number: 5,882,585

[45] Date of Patent: Mar. 16, 1999

[54] STEEL MATERIAL WITH HIGH THERMAL-RESISTANCE FOR PRODUCING ENGINE PISTON UPPER PARTS

[75] Inventors: Karl Wilhelm Wegner, Iserlohn; Heinz Werner Breuer, Ennepetal, both of Germany

[73] Assignee: Carl Dan Peddinghaus GmbH & Co. KG, Ennepetal, Germany

[21] Appl. No.: 945,791

[22] PCT Filed: Mar. 6, 1996

[86] PCT No.: PCT/EP96/00954

§ 371 Date: Feb. 4, 1998

§ 102(e) Date: Feb. 4, 1998

[87] PCT Pub. No.: WO97/33010

PCT Pub. Date: Sep. 12, 1997

[51] Int. Cl.[6] ..... C22C 38/12; C22C 38/06

[52] U.S. Cl. ..... 420/120; 420/124; 420/87

[58] Field of Search ..... 420/120, 124, 420/87

[56] References Cited

U.S. PATENT DOCUMENTS 2,229,140 1/1941 Smith et al. .

FOREIGN PATENT DOCUMENTS 0 085 828 A1 8/1983 European Pat. Off. .
2 246 579 A 2/1992 United Kingdom .
2 287 956 10/1995 United Kingdom .

*Primary Examiner*—Deborah Yee
*Attorney, Agent, or Firm*—Finnegan, Henderson, Farabow, Garrett & Dunner

[57] ABSTRACT

A steel material is useful for producing the upper part of engine pistons with high wear, corrosion and heat resistance. This steel has the following composition (in % by weight): 1.20 to 150 Mn; 0.50 to 0.80 Si; 0.35 to 0.40 C; 0.10 to 0.50 Mo; 0.08 to 0.13 V; 0.010 to 0.065 S; 0.015 to 0.050 Al; ≦0.035 P, the remainder being iron and production impurities.

2 Claims, No Drawings

STEEL MATERIAL WITH HIGH THERMAL-RESISTANCE FOR PRODUCING ENGINE PISTON UPPER PARTS

BACKGROUND OF THE INVENTION

The invention relates to a steel material for producing engine piston upper parts.

In diesel motors, extremely high compressions with good fuel utilization, low emissions and high km life expectancy can be obtained with steel forged piston upper parts. In this connection, the piston upper parts are generally quenched and tempered from the material 42CrMo4 in a range from 800 to 1100 N/mm$^2$, i.e. hardened by heating from room temperature to 860° C. and subsequently quenching in heavy-duty oil and tempered by renewed heating to ca. 480° to 660° C. with final cooling in a container. The temperatures in the hardening and/or tempering furnace are adjusted according to the respective steel analysis and the customer instructions with respect to strength.

The wear, corrosion and thermal resistance properties of the piston upper parts which are required by the consumer can only be obtained with the above mentioned steel and the forging method. However, the construction principle of the pendulum shaft piston with a steel forged upper part and aluminum skirt has the disadvantage that the motor is expensive in comparison to the one-piece pistons produced from aluminum which is also caused by the quenching and tempering (heat treatment) of the steel piston upper part.

The object of the present invention is to provide a material with which steel forged piston upper parts can be produced without quenching and tempering, and hence more economically, without negatively influencing the wear, corrosion and heat resistance properties.

SUMMARY OF THE INVENTION

This object is achieved according to the invention by a steel material which has the following composition (% by weight):

Mn: 1.20 to 1.50

Si: 0.50 to 0.80

C: 0.35 to 0.40

Mo: 0.10 to 0.50

V: 0.08 to 0.13

S: 0.010 to 0.065

Al: 0.015 to 0.050

P: ≦0.035 the remainder being iron and production impurities.

In this connection, the production impurities can especially include the elements Ni and Cr which can each generally be present in the steel material in an amount of ≦0.20% by weight.

DETAILED DESCRIPTION OF THE INVENTION

In this connection, the steels according to the invention can be produced in a customary manner in an electric oven, whereby scrap is employed as a starting material. This scrap is melted down in the electric oven and the melt is subsequently refined for reduction of the phosphorous content. The steel is run off in a ladle for secondary metallurgical treatment. This means that loading agents such as FeSi, FeCr, MnCr or FeMo are added as a function of the analysis of the steel obtained from the electric oven in order to adjust the ranges of the individual elements in the steel according to the invention. In this connection, aluminum is also added for steadying. The homogenization of the melt and its adjustment to the respectively desired temperature then occurs in a pan furnace. Subsequently, the fine adjustment of the weight amounts of the individual elements in the claimed steel occurs through the addition of the loading agents already mentioned above. Gases such as hydrogen dissolved in the melt are then removed by degassing. If necessary, corrections are carried out here with respect to the content of aluminum which is normally spooled in in wire form. Following the vacuum treatment, the melt is then cast into a billet or block.

Piston upper parts which must no longer be quenched and tempered can be steel forged with the steel according to the invention in order to obtain the desired high thermal resistance properties. The piston upper parts are cooled in a controlled manner from the forming heat (BY-treatment= BEST YIELD).

EXAMPLE

According to the process presented above, a steel material according to the invention was produced which has the following composition:

Mn: 1.31

Si: 0.57

C: 0.38

Mo: 0.43

V: 0.11

S: 0.046

Al: 0.024

P: 0.011

Cr: 0.17

Ni: 0.03 remainder is iron.

The steel of the above composition was compared with respect to its mechanical properties with the steel 42 CrMo4 (standard analysis according to the norm EN 10083). The results are presented in the following table:

TABLE

Comparison of hot-drawn samples

| 42CrMo4 | room temperature | 500° C. |
|---|---|---|
| tensile strength Rm (N/mm$^2$) | 930 | 630 |
| yield strength Rp 0.2 (N/mm$^2$) | | 480 |
| constriction Z (%) | | 75 |
| strain A5 (%) | | 25 |
| **steel according to example** | **room temperature** | **500° C.** |
| tensile strength Rm (N/mm$^2$) | 1020 | 810 |
| yield strength Rp 0.2 (N/mm$^2$) | | 605 |
| constriction Z (%) | | 58 |
| strain A5 (%) | | 14.5 |

The values of the above table demonstrate the advantageous mechanical properties of the steel according to the invention.

We claim:

1. Steel material comprising by weight percent:

1.20 to 1.50% Mn;

0.50 to 0.80% Si;

0.35 to 0.40% C;
0.10 to 0.50% Mo;
0.08 to 0.13% V;
0.010 to 0.065% S;
0.015 to 0.050% Al;
≦0.035 P;

the balance being iron and production impurities.

2. A method for producing a motor piston upper part comprising the step of steel forging the steel material of claim 1 into a motor piston upper part.

* * * * *